US007274334B2

(12) United States Patent
O'Riordan et al.

(10) Patent No.: US 7,274,334 B2
(45) Date of Patent: Sep. 25, 2007

(54) STACKED MULTI-RESONATOR ANTENNA

(75) Inventors: Pauline O'Riordan, Kildare (IE); Joseph Modro, Dublin (IE)

(73) Assignee: TDK Corporation, Tokyo (JP)

( * ) Notice: Subject to any disclaimer, the term of this patent is extended or adjusted under 35 U.S.C. 154(b) by 36 days.

(21) Appl. No.: 11/088,960

(22) Filed: Mar. 24, 2005

(65) Prior Publication Data

US 2006/0214850 A1 Sep. 28, 2006

(51) Int. Cl.
*H01Q 1/24* (2006.01)

(52) U.S. Cl. ..... 343/702; 343/700 MS; 343/895

(58) Field of Classification Search ..... 343/702, 343/700 MS, 895, 873, 893
See application file for complete search history.

(56) References Cited

U.S. PATENT DOCUMENTS

| | | | | |
|---|---|---|---|---|
| 6,069,592 | A | 5/2000 | Wass | 343/895 |
| 6,320,545 | B1 * | 11/2001 | Nagumo et al. | 343/700 MS |
| 6,459,413 | B1 * | 10/2002 | Tseng et al. | 343/700 MS |
| 6,946,994 | B2 * | 9/2005 | Imaizumi et al. | 343/702 |
| 7,023,385 | B2 * | 4/2006 | Harihara | 343/700 MS |
| 2001/0011964 | A1 | 8/2001 | Sadler et al. | 343/824 |
| 2002/0089453 | A1 | 7/2002 | Tseng et al. | 343/702 |

FOREIGN PATENT DOCUMENTS

| | | | |
|---|---|---|---|
| EP | 1 363 355 | A2 | 11/2003 |
| EP | 1 363 356 | A2 | 11/2003 |
| EP | 1 439 606 | A1 | 7/2004 |
| JP | 2001 217632 | A | 8/2001 |
| WO | WO 01/11721 | A1 | 2/2001 |

* cited by examiner

*Primary Examiner*—Douglas W. Owens
*Assistant Examiner*—Ephrem Alemu
(74) *Attorney, Agent, or Firm*—Oliff & Berridge, PLC

(57) ABSTRACT

An antenna structure having a ground plane, a feed line and at least one resonator element that is embedded in a dielectric substrate and which is meandering in shape such that it includes at least two adjacent resonator segments. As a result, the resonator element resonates in two separate frequency bands. A second resonator element is provided, the second resonator element being dimensioned to resonate in a frequency band below a third operating frequency band, the feed line and ground plane being arranged to cause a resonance in a frequency band located above the third operating frequency band. During use, the combined effect of the resonance of the second resonator element and of the feed line and ground plane is to cause the antenna structure to resonate in the third operating frequency band.

18 Claims, 6 Drawing Sheets

STACKED MULTI-RESONATOR ANTENNA

FIELD OF THE INVENTION

The present invention relates to antennas. The invention relates particularly to antennas intended for use in portable wireless communication devices such as laptops and personal digital assistants.

BACKGROUND TO THE INVENTION

In recent times, an increasing demand for efficient and timely remote mobile access to email and the internet, has aroused the need for versatile portable wireless communication devices, especially broadband devices. Mobile communication devices that are designed to operate in many locations around the world have also become increasingly popular.

For such applications, antennas are required to be capable of operating on multiple frequency bands to be compatible with different global standards. In addition, typical portable device antennas are required to be small in size and low in cost.

One approach in realizing an antenna capable of operating on more than one band is to fabricate multiple metalised elements on separate layers of a multilayer dielectric substrate, where each metalised element is designed to resonate at the centre frequency of one of the bands of operation of the antenna. For example, the stacked meander antenna described in European Patent Application EP 1 363 355 comprises two resonating meander elements, one for each band of operation of the antenna. EP 1 363 355 also teaches that, if the antenna is required to operate on three frequency bands, then three meander elements are required.

The provision of separate resonating meander elements for each band of operation of a multi-band antenna is one method to achieve the required electrical characteristics of the multi-band antenna. However, as the number of required bands of operation of the antenna increases, the provision of a separate meander resonator for each band of operation of the antenna increases the overall size and the cost of the multi-band antenna.

It would be desirable, therefore, to provide an antenna capable of operating on N frequency bands, which comprises less than N resonating meander elements.

SUMMARY OF THE INVENTION

Accordingly, a first aspect of the invention provides an antenna structure comprising at least one resonator element, a ground plane and a feed line, wherein said at least one resonator element is meandering in shape such that said at least one resonator element includes at least two adjacent resonator segments, and wherein said at least one resonator element is embedded in a dielectric substrate.

Embedding the meandering resonator in the dielectric substrate causes the resonator to resonate in at least two separate frequency bands, thereby providing at least two respective operating frequency bands.

Preferably, said at least one resonator element includes at least one corner section, said at least one corner section being curved. Curved corner sections facilitate current flow in the resonator during use.

In one embodiment, said at least one resonator element includes a first resonator element, said antenna structure further including a second resonator element, wherein in respect of an operating frequency band of said antenna structure, said second resonator element is dimensioned to resonate in a frequency band located on one side of said operating frequency band, the feed line and ground plane being arranged to cause a resonance in a frequency band located on the other side of said operating frequency band, wherein, during use, the combined effect of the resonance of said second resonator element and of said feed line and ground plane is to cause said antenna structure to resonate in said operating frequency band. This provides an additional operational frequency band for the antenna structure.

In preferred embodiments, said at least one resonator element includes a first resonator element, said antenna structure further including a second resonator element, said first and second resonator element having a single, common feed point connected to said feed line, and being dimensioned to serve as respective quarter wavelength resonators for a respective frequency band.

Advantageously, said second resonator element is embedded in said dielectric substrate. The second resonator element may be meandering in shape.

Preferably, said first resonator element lies in a first plane and said second resonator element lies in a second plane, said first and second planes being substantially parallel with one another.

In preferred embodiments, the antenna structure includes a resonator component comprising said at least one resonator element embedded in said dielectric substrate, said at least one resonator element lying in a first plane, said ground plane being spaced apart from said resonator component so that said ground plane does not overlap with said at least one resonator element in a direction substantially perpendicular with said first plane.

The ground plane is, advantageously, substantially parallely disposed with respect to said first plane.

In preferred embodiments, said at least one resonator element has a single feed point and extends from said feed point generally in a first direction, said resonating component being spaced apart from said ground plane in a direction substantially perpendicular with said first direction.

The antenna structure typically includes an excitation point located in register with said ground plane, said feed line extending between said excitation point and said feed point. The preferred arrangement is such that said at least one resonator element extends from said feed point generally in a first direction, said feed line extending in a direction substantially perpendicular with said first direction. The feed line advantageously comprises a length of transmission line extending substantially the entire distance between the feed point and the excitation point.

Typically, the antenna structure is provided on a substrate having an obverse surface and a reverse surface, said resonator component and said feed line being provided on said obverse face, said ground plane being provided on said reverse face.

A second aspect of the invention provides an antenna structure comprising a ground plane, a feed line, and at least one resonator element, wherein in respect of an operating frequency band of said antenna structure, said at least one resonator element is dimensioned to resonate in a frequency band located on one side of said operating frequency band, the feed line and ground plane being arranged to cause a resonance in a frequency band located on the other side of said operating frequency band, wherein, during use, the combined effect of the resonance of said at least one resonator element and of said feed line and ground plane is to cause said antenna structure to resonate in said operating frequency band.

A third aspect of the invention provides a wireless communications device comprising the antenna structure of the first aspect of the invention.

Further advantageous aspects of the invention will become apparent to those ordinarily skilled in the art upon review of the following description of a specific embodiment and with reference to the accompanying drawings.

BRIEF DESCRIPTION OF THE DRAWINGS

An embodiment of the invention is now described by way of example and with reference to the accompanying drawings in which.

DETAILED DESCRIPTION OF THE DRAWINGS

Figures 1A, 1B, 1C:
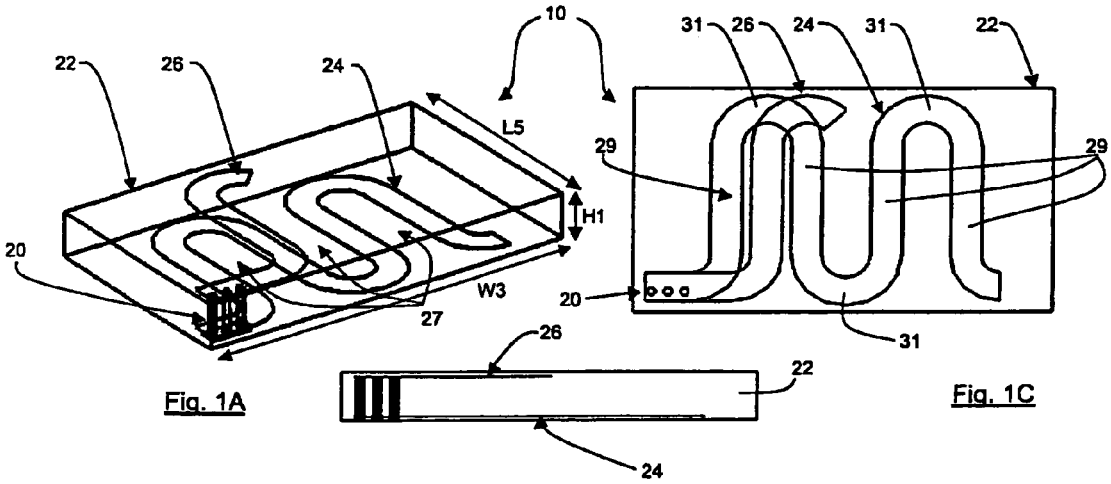
FIG. 1A shows a perspective view of an antenna (excluding ground plane) embodying the present invention.
FIG. 1B shows a plan view of the antenna of FIG. 1A.
FIG. 1C shows a side view of the antenna of FIG. 1A.

FIGS. 1A to 1C and FIGS. 3A and 3B illustrate an antenna structure, generally indicated as 8, embodying the present invention. The illustrated antenna structure 8 is capable of operating in three main frequency bands and may therefore be referred to as a tri-band antenna. In other embodiments, the antenna may be capable of operating in at least two or more than three frequency bands.

The antenna structure 8 comprises a resonating structure 10 (which is commonly referred to as the antenna, or sometimes as a microchip antenna) and a ground plane 14. The antenna structure 8 also includes a feed line 16 by which electrical signals may by supplied to and/or received from the antenna 10.

The antenna 10 comprises at least two stacked, or layered, resonator elements 24, 26 at least one of which is curved, meandering or generally sinuous or zigzag in shape. Each resonator element 24, 26, which in the context of the preferred embodiment is hereinafter referred to as a meander resonator, may comprise a respective length of transmission line, for example microstrip line. In the preferred embodiment, the antenna 10 comprises a first meander resonator 24 and a second meander resonator 26. The resonators 24, 26 are stacked in that they each lie in a respective plane that is substantially parallel with the plane in which the other resonator 26, 24 lies. The meander resonators 24, 26 are each dimensioned to serve as λ/4 resonators for a respective frequency band.

Both resonators 24, 26 are embedded in a block or substrate 22 of electrically insulating or non-conducting material, typically dielectric material, i.e. a material having a dielectric constant that is greater than 1. In the preferred embodiment, the resonators 24, 26 are embedded such that they are entirely surrounded by dielectric material. In alternative embodiments, the embedding is such that at least the obverse face and the reverse face of at least one meandering resonator is covered by dielectric material, although it is preferred that the edges or sides of the resonator is also covered by dielectric material. The embedding should in any event be such that the E fields emanating from the resonator during use are manipulated to cause coupling between adjacent segments of the meander, as is described in more detail below.

The antenna 10 is provided, or mounted, on a first or obverse surface 11 of a substrate 12 typically of dielectric material, for example a printed circuit board (PCB). The preferred arrangement is such that the meander resonators 24, 26 are substantially parallely disposed with respect to the surface 11. The PCB 12 has a second or reverse surface 13 (opposite to the obverse surface 11) on which there is provided the ground plane 14. Typically, the ground plane 14 comprises a layer of conducting material, for example copper, and is conveniently generally rectangular in shape. The arrangement is such that the ground plane 14 does not extend beneath the antenna 10, i.e. does not overlap with the antenna 10 in a direction perpendicular with the planes in which the meander resonators 24, 26 lie. Moreover, it is advantageous that the ground plane 14 is spaced apart from the antenna 10 in a direction substantially perpendicular to the direction in which the resonators 24, 26 are spaced apart. To this end, the reverse face 13 of the PCB 12 is partially covered by the ground plane 14 and is so divided into a ground plane section 14 and a non-ground plane section 15, the antenna 10 being provided on the obverse face 11 opposite, or in register with, the non-ground plane section 15 of the reverse face 13.

The feed line 16 preferably takes the form of a length of transmission line, for example microstrip line. In the preferred embodiment, the feed line 16 comprises a 50Ω microstrip feed line. Preferably, the feed line 16 is provided on the obverse surface 11 of the PCB 12. The antenna 10 includes a feed point 20, one end of the feed line 16 being connected to the feed point 20. The other end of the feed line 16 is connected to an excitation point 18. The excitation point 18 is typically located in register with the ground plane 14 and so, in extending between the excitation point 18 and the feed point 20, a first portion of the feed line 16 is in register with the ground plane 14, while a second portion of the feed line 16 is in register with the non-ground plane section 15 of the reverse face 13 of the PCB 12, i.e. the second portion of the feed line 16 traverses the gap between the ground plane 14 and the antenna 10. The excitation point 18 is connected to a connector, for example an SMA (subminiature version A) connector by which signals may be fed to and received form the feed line 16.

It will be seen that the resonators 24, 26 are fed from a single common feed point 20 located at a respective end of each resonator 24, 26 (said respective ends being electrically connected together). Hence, during use, the resonators 24, 26, in conjunction with the ground plane 14, act as λ/4 monopoles. Moreover, it will be seen that the respective ends from which the resonators 24, 26 are fed are substantially in register with one another in the direction of spacing of the resonators 24, 26.

Each meander resonator 24, 26 may be said to extend generally in a first direction (D1) from the feed point 20, wherein said first direction D1 is the general direction in which a multi-loop meander resonator progresses with length, or the general direction between adjacent loops (when more than one loop is present). In the preferred embodiment, the meander resonators 24, 26 and the ground plane 14 are located in generally parallel planes but the antenna 10 (and therefore the resonators 24, 26) and the ground plane 14 are spaced-apart from one another in a direction substantially perpendicular with said first direction D1 and substantially perpendicular to the direction in which the resonators 24, 26 are spaced apart.

At least one of the meander resonators (in the present example resonator 24) is shaped to define at least one loop 27, and typically a plurality of loops 27. The loops 27 are defined by a plurality transmission line segments 29 that are spaced-apart in the direction D1 (and which typically are substantially or generally parallel with one another), adjacent segments 29 being joined together at one end by a respective transmission line corner segment 31 to form a meandering resonator. Advantageously, the corner segments 31 are curved or rounded (as illustrated) to create a sinuous shape although, in alternative embodiments, the corner segments may be straight.

It is preferred that the resonators 24, 26 are staggered in the direction D1 to reduce or minimize the amount of overlap between resonators 24, 26 in the direction D1. This reduces coupling between resonators 24, 26 during use. As may best be seen from FIG. 1B, it is preferred that the respective segments 29 of resonators 24, 26 do not overlap in direction D1.

In the preferred embodiment, the feed line 16 runs substantially perpendicularly to the direction D1 and, in the illustrated embodiment, substantially perpendicularly to the edge 19 of the ground plane 14.

The antenna structure 8 has three separate modes of operation, arising from the two stacked λ/4 meander resonators 24, 26. The three modes of operation of the antenna structure 8 are referred to below as a first, or low-band, mode; a second, or mid-band, mode; and a third, or high-band, mode. Consequently, the antenna structure 8 can be used to transmit or receive electromagnetic signals, normally RF (Radio Frequency) signals, on three corresponding frequency bands: a low frequency band; a middle frequency band; and a high frequency band.

In the preferred embodiment, the geometric structure of the stacked meander resonators 24, 26 is carefully selected to produce a triple-band antenna capable of operating in the desired frequency bands. Also, the ground plane 14 of the antenna structure 8, the feed line 16 to the antenna structure 8 and the electrical properties of the dielectric substrate 22 give rise to a number of advantageous effects in achieving the triple-band operation of the antenna structure 8.

The low-band mode of operation is generated by the longer of the two λ/4 meander resonators, namely resonator 24. The frequency of the resonance in this mode is determined primarily by the length of the resonator 24. It is noted, however, that the effect of the dielectric substrate 22 on this mode of operation is a reduction in the length of resonator 24 required compared with the length that would have been required had the resonator been in free space, i.e. the substrate 22 has the effect of reducing the effective electrical length of the resonator 24.

Figure 2A:
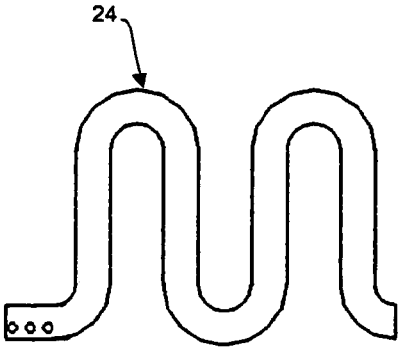
FIGS. 2A and 2B illustrate E-field direction of a λ/4 meander resonator in free space.
Figure 2C:
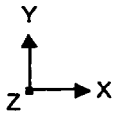
FIGS. 2C and 2D illustrate E-field direction of a λ/4 meander resonator embedded in dielectric substrate.
Figure 2C:
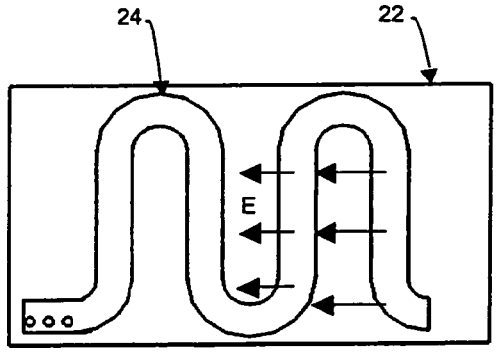
Figure 2B:
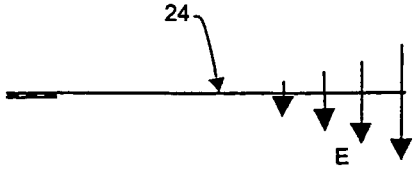
Figure 2D:
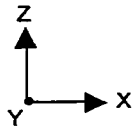
Figure 2D:
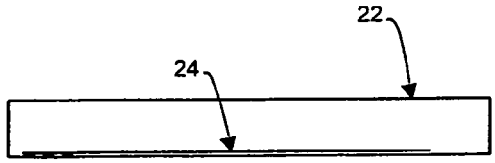
Figures 3A, 3B:
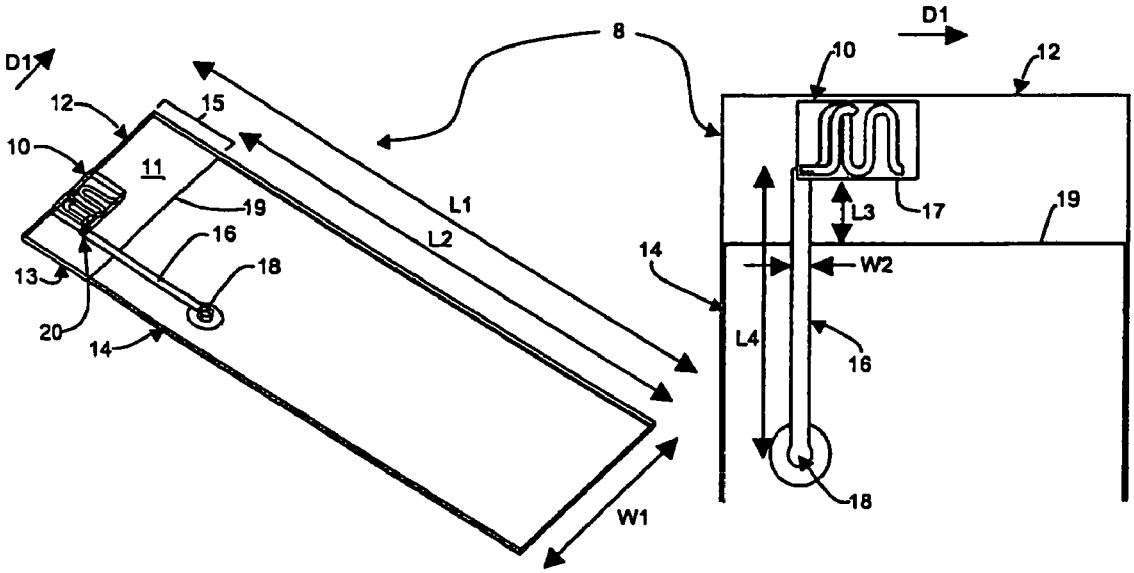
FIG. 3A shows a perspective view of the antenna of FIGS. 1A to 1C including a ground plane and feed line.
FIG. 3B shows a plan view of the antenna, ground plane and feed line of FIG. 3A in part.

The high-band mode of operation is also generated by the resonator 24. In this mode, it is found that, because the resonator 24 is embedded in substrate 22 so as to be surrounded by dielectric material (at least so that substrate surrounds the obverse face and reverse face of the resonator 24), the dielectric substrate 22 facilitates a change in direction of the electromagnetic fields, in particular the near fields, generated by the resonator 24 during use. The arrows E in FIG. 2B show the direction of the electric field supported by the resonator 24 in free space. In this case, the electric fields E are dominant in the z-direction (as defined in FIG. 2). When the same meander resonator 24 is embedded in a dielectric substrate, the electric field orientation is seen to change from the z-direction to the x-y plane, as shown in FIG. 2C.

The change of E-field direction induces coupling between the adjacent line segments 29 of the meander resonator 24 which is only significant at high frequencies. The coupling between adjacent line segments 29 of the meander resonator 24 considerably reduces the effective electrical length of the meander resonator 24 at high frequencies. The shortening of the meander resonator 24 through coupling of adjacent sections 29 at higher frequencies introduces the high band mode of operation by allowing the meander resonator 24 to resonate at a much higher frequency than in the low band mode.

The third mode, which in this example is the mid-band mode, of operation is generated by a combination of two resonances, one from the resonator 26 and another from the environment surrounding the antenna 10, in particular the feed line 16 and the ground plane 14. The shorter of the two λ/4 meander resonators 26 embedded in the dielectric substrate 22 gives rise to a resonance just below the desired frequency range of the mid-band mode of the antenna structure 8. It should be noted that the dielectric substrate 22 changes the boundary conditions of the meander resonator 26 and changes the impedance of the resonator 26 seen at the feed point 20, and these factors also contribute to the frequency of this resonance.

Since this is a monopole antenna design, the antenna's operation is dependent on its external parameters. For example, the frequencies at which the antenna structure 8 resonates can be adjusted or de-tuned by varying the length of the feed line 16, and/or by varying the size of the application ground plane 14, and/or or by changing the position of the antenna 10 with respect to its ground plane 14 (including adjusting the size of the gap or spacing between the antenna 10 and ground plane 14). De-tuning occurs because, for a monopole design, the feed line and ground plane are inherently part of the resonating structure. For the antenna structure 8, the feed line 16 and ground plane 14 are constructed and arranged in such a way as to introduce an additional resonance, located at a frequency above the resonance caused by the resonator 26 described in the preceding paragraph. It is observed that this additional resonance arises at least in part as a result of resonance of the feed line 16 and is dependant on the parameters described above including the length of the feed line 16, the size of the application ground plane 14, and/or the position of the antenna 10 with respect to its ground plane 14. This additional resonance de-tunes, or adjusts, the resonance of the resonator 26 to produce the mid-band mode of the operation of the antenna structure 8.

It is noted that the resonator 26 need not comprise a meander resonator. The length of the resonator 26 depends on the frequency at which it is required to resonate. In some, embodiments, therefore, the resonator 26 may be too short to necessitate comprising curves or loops. In other embodiments, the resonator 26 may include one or more curve or loop.

It will be seen therefore, that, in the preferred embodiment, the antenna structure 8 serves as a triple-band antenna which has: a first mode of operation, a second mode of operation, and a third mode of operation, where the modes of operation of the antenna occur on respective, typically separate or non-overlapping, frequency bands. The antenna structure 8 comprises a first λ/4 meander resonating element 24 and a second λ/4 resonating element (which may be a meander resonator), where the first and second resonating, or radiating, elements 24, 26 of the antenna structure 8 are fabricated in, or embedded in, a dielectric substrate 22. The first mode of operation of the antenna structure 8 is due to a fundamental resonance of the first resonating element 24, the second mode of operation of the antenna structure 8 is due to a resonance of the second resonating element 26 of the antenna in conjunction with a resonance caused by the operating environment of the antenna structure 8, and where the third mode of operation of the antenna structure 8 is due to a higher order resonance of the first resonating element 24 of the antenna structure 8, where the higher order resonance is caused by coupling between adjacent line sections 29 of the first resonating element 24.

In a preferred embodiment, the width ($W_1$) of the PCB 12 is approximately 34 mm and the length ($L_1$) of the PCB 12 is approximately 86.5 mm. The ground plane surface 14 has substantially the same width ($W_1$) as the PCB (12) and has a length ($L_2$) of approximately 75 mm. As indicated above, the antenna (10) is mounted on the opposite side 11 of the PCB 12 to that of the ground plane 14 and the ground plane 14 does not extend under the antenna 10. The antenna 10 has an edge 17 that is generally parallel to the direction D1. The ground plane 14 has an edge 19 that is generally parallel to the direction D1. The edge 17 is spaced apart from the edge 19 by a distance ($L_3$)which, in the preferred embodiment, is approximately 5 mm . The length ($L_4$) of the feed line 16 from the point of excitation 18 on the PCB 12 to the feed point 20 at the antenna 10 is approximately 16.5 mm. The width ($W_2$) of the feed line 16 is approximately 1.5 mm.

The dielectric substrate 22 may have a width (W3) (in the direction D1) of approximately 10 mm, a length (L5) of approximately 6 mm and a height (H1) approximately of 1.2 mm. The preferred dielectric substrate has a dielectric constant and loss tangent of 7.5 and 0.0033, respectively. The λ/4 meander resonators may be fabricated in the dielectric substrate 22 by printing and subsequently baking a silver based conductor paste on the surfaces of a multi-layered dielectric substrate.

Figure 4A:
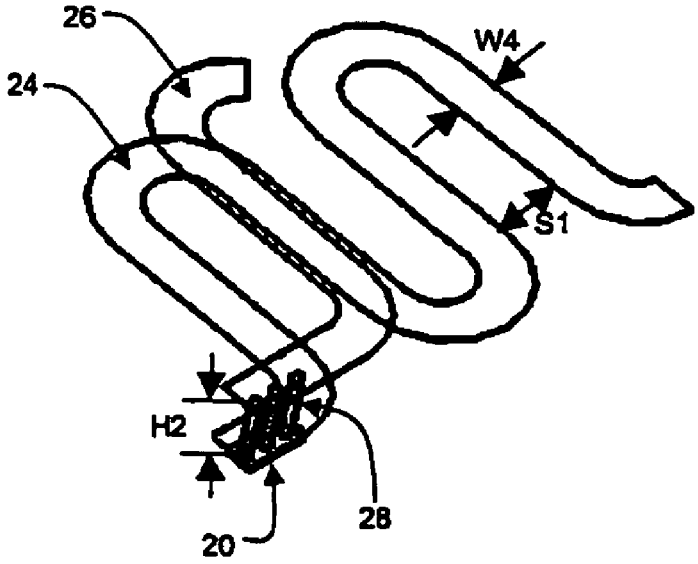
FIG. 4A shows a perspective view of the individual λ/4 meander resonators of the antenna of FIG. 1 without the dielectric substrate.
Figure 4B:
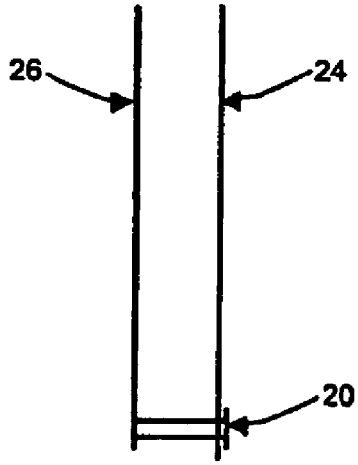
FIG. 4B shows a side view of the individual λ/4 meander resonators of the antenna of FIG. 1 without the dielectric substrate.

FIGS. 4A and 4B shows the meander resonators 24, 26 and the feed point 20 without the substrate 22. The meander resonators 24, 26 are stacked in a direction substantially perpendicular to the respective planes in which the resonators 24, 26 lie. The spacing (H2) between the resonators 24, 26 may be approximately 1 mm.

The preferred width (W4) of the meander resonators is approximately 0.75 mm.

In the preferred embodiment, the spacing (S1) between adjacent segments 29 is approximately 1.15 mm.

The meander resonators 24, 26 are electrically connected at the feed point 20 by at least one conductive via 28. Three adjacent vias 2 are provided side-by-side in the illustrated embodiment.

For the preferred embodiment having the dimensions provided above, the meander resonator 24 exhibits a fundamental resonance at approximately 2.36 GHz, which gives rise to a best match at 2.5 GHz (this corresponds to band 1 of industry standards-based technology WiMax). The meander resonator 24 also exhibits a higher order resonance at approximately 5.77 GHz, which gives rise to a best match at 5.8 GHz (this corresponds to WiMax frequency band 3). The top meander resonator 26 resonates at approximately 3.2 GHz, and a further resonance occurs at approximately 4.26 GHz due to resonance in the feed line 16. A best match is found between these two resonances at 3.5 GHz (this corresponds to WiMax frequency band 2).

Figure 5:
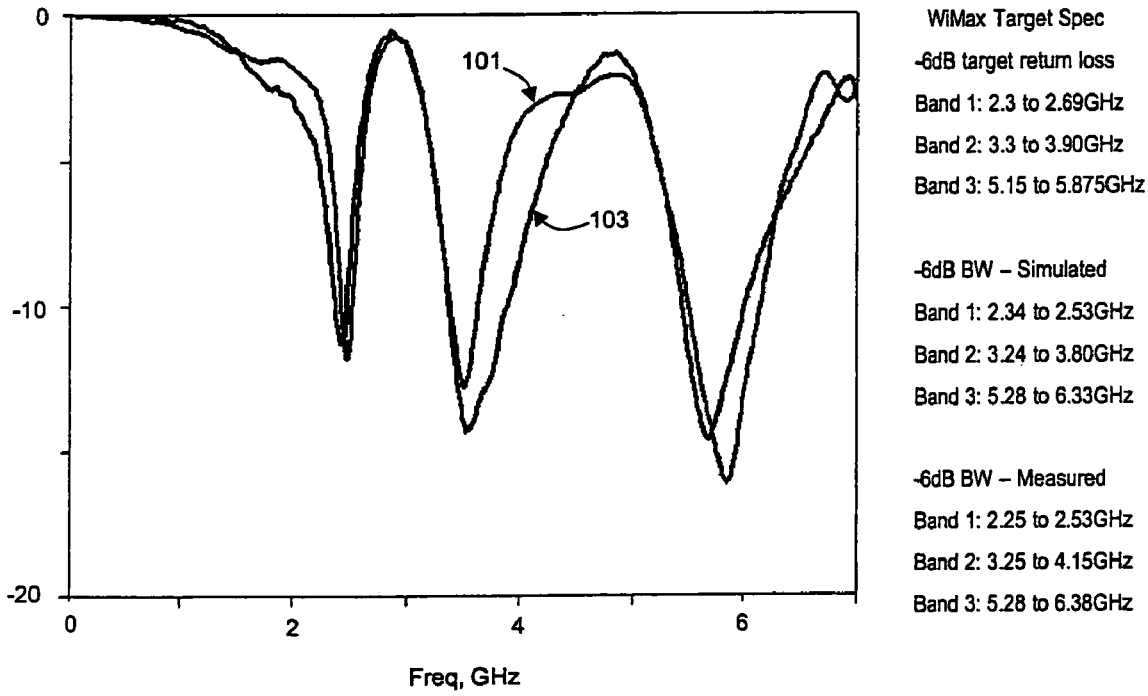
FIG. 5 shows a graph plotting loss versus frequency for the preferred embodiment of the present invention.

FIG. 5 is a graph illustrating the relationship between frequency and return loss of the preferred antenna structure 8 described above. Simulated data is shown as 101 and measured data is presented at 103.

Figure 6:
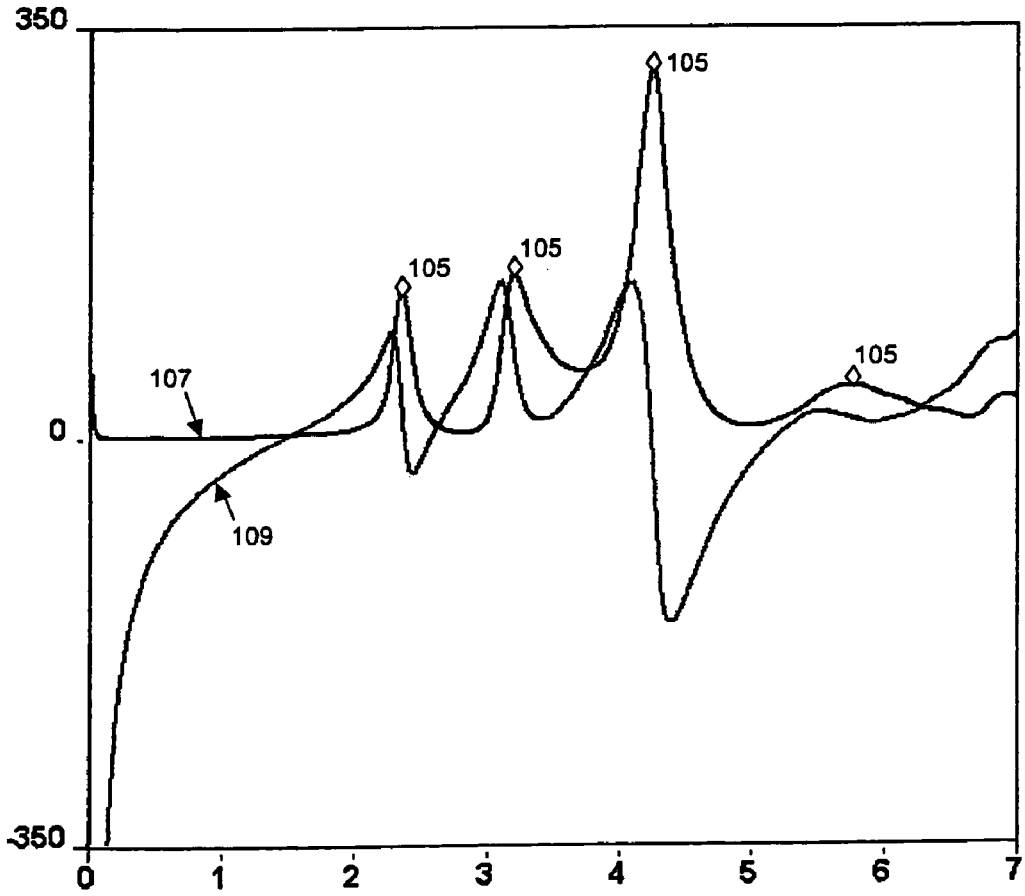
FIG. 6 shows a graph plotting real and imaginary impedance versus frequency for the preferred embodiment of the present invention.

FIG. 6 is a graph illustrating the relationship between frequency and the real 107 and imaginary 109 impedances for the preferred antenna structure 8. The four resonances of the antenna structure 8 are highlighted by markers 105.

The invention is not limited to the embodiment described herein which may be modified or varied without departing from the scope of the invention.

The invention claimed is:

1. An antenna structure comprising at least one resonator element, a ground plane and a feed line, wherein said at least one resonator element includes a first resonator element comprising a first end and a second end, said first resonator element being meandering in shape to define at least two adjacent resonator segments between said first and second ends, the antenna structure being operable in at least a first operating frequency band and a second operating frequency band, the second operating frequency band having a higher center frequency than said first operating frequency band, wherein said first resonator element has a physical length between said first and second ends which causes said first resonator to resonate in said first operating frequency band when said first resonator element is excited by a signal in a first operation frequency band, and wherein said at least one resonator element is embedded in a dielectric substrate and the spacing between said at least two adjacent resonator segments is such that, when said first resonator element is excited by a signal in said second operating frequency band, electromagnetic coupling occurs between said at least two adjacent resonator segments and causes said first resonator element to resonate in said second operating frequency band.

2. An antenna structure as claimed in claim 1, said antenna structure further including a second resonator element, said first and second resonator elements having a single, common feed point connected to said feed line, wherein in respect of a third operating frequency band of said antenna structure, said second resonator element is dimensioned to resonate in a frequency band which has a lower center frequency than said third operating frequency band, the feed line and ground plane being arranged to cause a resonance in a frequency band which has a higher center frequency than said third operating frequency band, the second resonator element, the feed line and the ground plane being dimensioned and arranged such that the combined effect of the respective resonance of said second resonator element and of said feed line and ground plane is to cause said antenna structure to resonate in said third operating frequency band.

3. An antenna structure as claimed in claim 1, in which said first resonator element includes at least one corner section, said at least one corner section being curved.

4. An antenna structure as claimed in claim 2, wherein said first and second resonator elements have a single, common feed point connected to said feed line, said first resonator element being dimensioned to serve as a quarter wavelength resonator in said first operating frequency band, said second resonator element being dimensioned to serve as a quarter wavelength resonator in a frequency band having a center frequency below said third operating frequency band.

5. An antenna structure as claimed in claim 4, wherein said second resonator element is embedded in said dielectric substrate.

6. An antenna structure as claimed in claim 4, wherein said second resonator element is meandering in shape.

7. An antenna structure as claimed in claim 4, wherein said first resonator element lies in a first plane and said second resonator element lies in a second plane, said first and second planes being substantially parallel with one another.

8. An antenna structure as claimed in claim 1, including a resonator component comprising said at least one resonator element embedded in said dielectric substrate, said resonator component lying on a planar surface of a substrate, said ground plane being spaced apart from said resonator component so that said ground plane does not overlap with said at least one resonator element in a direction substantially perpendicular to said first planar surface.

9. An antenna structure as claimed in claim 8, wherein said ground plane is substantially parallely disposed with respect to said first plane.

10. An antenna structure as claimed in claim 8, wherein said at least one resonator element has a single feed point and extends from said feed point generally in a first direction, said resonating component being spaced apart from said ground plane in a direction substantially perpendicular with said first direction.

11. An antenna structure as claimed in claim 8, wherein said at least one resonator element has a single feed point and said antenna structure further includes an excitation point located in register with said ground plane, said feed line extending between said excitation point and said feed point.

12. An antenna structure as claimed in claim 11, wherein said at least one resonator element extends from said feed point generally in a first direction, said feed line extending in a direction substantially perpendicular with said first direction.

13. An antenna structure as claimed in claim 11, wherein said feed line comprises a length of transmission line.

14. An antenna structure as claimed in claim 8, wherein said substrate has an obverse surface and a reverse surface, said resonator component and said feed line being provided on said obverse surface, said ground plane being provided on said reverse surface.

15. An antenna structure comprising a ground plane, a feed line, and at least one resonator element, wherein in respect of an operating frequency band of said antenna structure, said at least one resonator element is dimensioned to resonate in a frequency band having a lower center frequency than said operating frequency band, the feed line and ground plane being arranged to cause a resonance in a frequency band having a higher center frequency than said operating frequency band, said at least one resonator element, the feed line and the ground plane being dimensioned and arranged such that the combined effect of the respective resonance of said at least one resonator element and of said feed line and ground plane is to cause said antenna structure to resonate in said operating frequency band.

16. A wireless communications device operable in at least a first operating frequency band and a second operating frequency band, the device comprising an antenna structure comprising at least one resonator element, a ground plane and a feed line, wherein said at least one resonator element includes a first resonator element comprising a first end and a second end, said first resonator element being meandering in shape to define at least two adjacent resonator segments between said first and second ends, the antenna structure being operable in at least the first operating frequency band and the second operating frequency band, the second operating frequency band having a higher center frequency than said first operating frequency band, wherein said first resonator element has a physical length between said first and second ends which causes said first resonator to resonate in said first operating frequency band when said first resonator element is excited by a signal in the first operating frequency band, and wherein said at least one resonator element is embedded in a dielectric substrate and the spacing between said at least two adjacent resonator segments is such that, when said first resonator element is excited by a signal in said second operating frequency band, electromagnetic coupling occurs between said at least two adjacent resonator segments and causes said first resonator element to resonate in said second operating frequency band, wherein said wireless communications device is connected to said antenna structure via said feed line and is adapted to transmit or receive signals in both said first operating frequency band and said second operating frequency band via said first resonator element.

17. An antenna structure as claimed in claim 1, wherein, in said first operating frequency band, the first resonator element exhibits a first electrical length determined by said physical length and said dielectric substrate, and in said second operating frequency band, said first resonator element exhibits a second electrical length determined by said physical length, said dielectric substrate and said electromagnetic coupling between said at least two adjacent resonator segments, wherein said second electrical length is smaller than said first electrical length.

18. An antenna structure as claimed in claim 17, wherein said first electrical length is substantially equal to a quarter of one wavelength of signals in said first operating frequency band, and said second electrical length is substantially equal to a quarter of one wavelength of signals in said second operating frequency band.

* * * * *